United States Patent [19]

Mesia

[11] 4,182,242

[45] Jan. 8, 1980

[54] BLAST HOLE LINER

[75] Inventor: Charles R. Mesia, Mountain Iron, Minn.

[73] Assignee: Mesabi Jobbers, Inc., Virginia, Minn.

[21] Appl. No.: 805,279

[22] Filed: Jun. 10, 1977

[51] Int. Cl.[2] ..... F42B 3/00

[52] U.S. Cl. ..... 102/22 R; 102/24 R

[58] Field of Search ..... 102/22, 23, 24 R

[56] References Cited

U.S. PATENT DOCUMENTS

| | | | |
|---|---|---|---|
| 3,760,727 | 9/1973 | Callister et al. | 102/24 R |
| 3,881,417 | 11/1973 | Mesia | 102/24 R |
| 4,019,438 | 4/1977 | Swanson | 102/24 R |

FOREIGN PATENT DOCUMENTS

| | | | |
|---|---|---|---|
| 667051 | 7/1963 | Canada | 102/24 R |

*Primary Examiner*—Verlin R. Pendegrass

*Attorney, Agent, or Firm*—James R. Haller

[57] ABSTRACT

The invention relates to a flat storable blast hole liner of the type used for lining blast holes in the mining industry. The liner has a pocket arrangement at its lower end for holding weighting material, the weighted pocket facilitating insertion of the liner, when empty of explosive, into a blast hole. The pocket arrangement comprises two pockets at the bottom of the liner and on opposite sides thereof, either of which may be filled with weighting material. The weighted pocket provides the liner with a generally rounded, bullet-shaped lower end. As the liner is lowered into a blast hole, the pointedness of the lower end tends to center the liner in the hole. Upon reaching the bottom of the hole the weighted pocket sags to one side of the hole and thereby allows later added explosive material to be received at the very bottom of the hole.

5 Claims, 5 Drawing Figures

FIG. 1
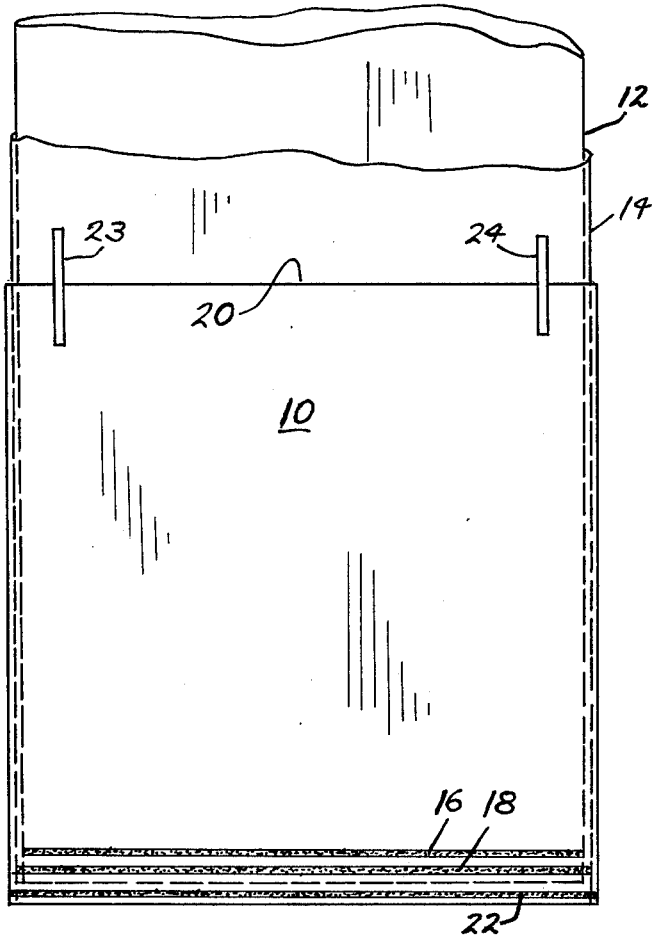
FIG. 2
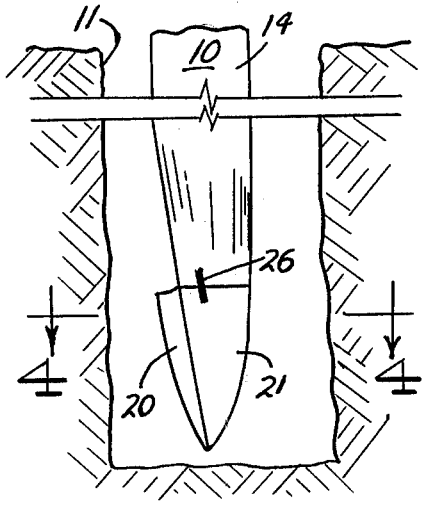
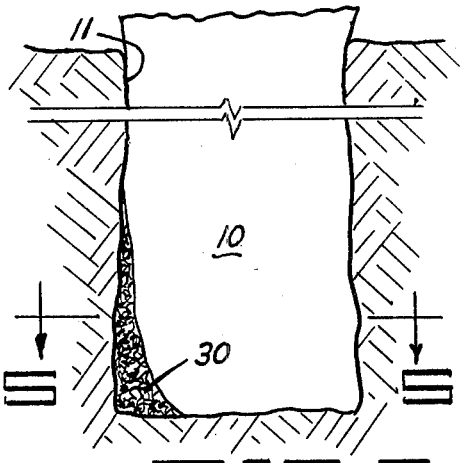
FIG. 3
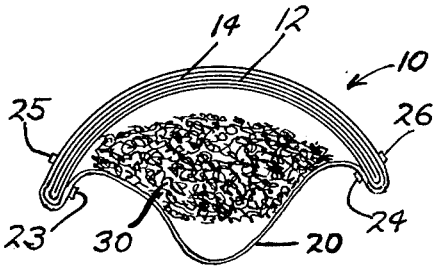
FIG. 4
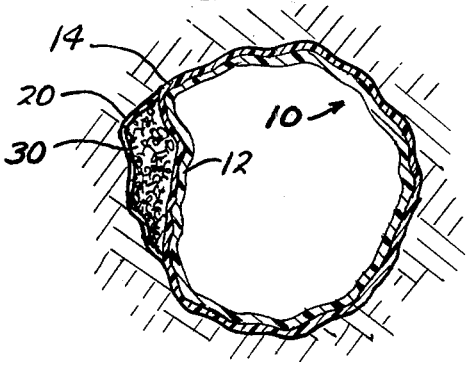
FIG. 5

BLAST HOLE LINER

BACKGROUND OF THE INVENTION

The invention relates to a new and improved flat-storable blast hole liner of the type used for lining blast holes and, more particularly, to such a liner of the type having a pocket arrangement for holding weight materials to facilitate insertion of the liner unit into a blast hole.

In the mining industry where the mineral lies substantially below ground level, blast holes are bored for receiving explosive charges. Detonating of the charges breaks up the hard material surrounding the holes. An ammonium nitrate-fuel oil mixture (commonly known as "ANFO") is often employed as the explosive. Water (eg, from rain or ground water sources) has a deleterious effect upon the explosive quality of this material, however, and accordingly it is common practice to insert waterproof plastic liners into the blast holes for holding the explosive charges. Such liner units may be equipped with pouch arrangements at the lower ends thereof for receiving rock "cuttings" or like weighting material to facilitate the lowering of the liner units into the blast holes. Liners of this general type are described in commonly owned U.S. Pat. Nos. 3,760,727 and 3,881,417, as well as in Canadian Pat. No. 667,051.

SUMMARY OF THE INVENTION

The liner of the present invention has a new and improved construction which has proved advantageous from the standpoint of being economical to manufacture and being simple to load with weighting materials by workmen. More important, however, is that the weighted pocket forms a prow-like front portion having a bullet-shaped configuration for guiding and pulling the leading end of the liner into a blast hole while simultaneously protecting the liner from being torn or otherwise pierced by jagged edges of the hole.

Also of significant importance is that when the weighted pocket reaches the bottom of the blast hole, it sags to one side of the hole so as to leave an unoccupied portion of the bottom of the liner coextensive with the bottom of the blast hole. This means that the explosive charge, when loaded into the liner, will reach to the floor of the blast hole rather than resting above the floor upon the weight pocket.

Briefly, the blast hole liner of the invention comprises an elongated, flattened, flexible, waterproof tube having a transversely extending waterproof seal at its bottom end and an open upper end. A flexible, short outer sleeve surrounds the lower end of the tube and is transversely sealed at its lower end to the lower end of the tube and is open upwardly. Fastening means supportively fasten the sleeve to the tube above the lower tube end. The sleeve thus forms, with the tube, an open weight pocket on each side of the tube adjacent its lower end.

In use, one of the weight pockets is loaded with weighting material. When suspended in a blast hole, the flattened tube tends to curl laterally under the weight in the pocket, thus presenting a more or less cylindrical cross section to the blast hole which aids in lowering of the liner to the floor of the hole. The lower end of the tube is protected from the often rough surface of the blast hole on one side by the pocket filled with weighting material and on the other side by at least two plys of liner material. When the floor of the hole is reached, the weighting material sags along one side of the hole, thus permitting the liner to be efficiently loaded with explosive all the way to the floor level.

Preferably, a second tube is disposed within the first tube for added protection of the explosive from moisture. The inner, second tube is also provided with a transverse, waterproof seal at its lower end, and desirably is substantially coextensive with the first tube.

BRIEF DESCRIPTION OF THE DRAWING

FIG. 1 is an elevational broadside view, partly in section, of the lower end portion of a blast hole liner embodying the invention;

FIG. 2 is a reduced scale side view of the lower end portion of the blast hole liner of FIG. 1 shown as it is being lowered in a blast hole and just prior to reaching the bottom, the blast hole being shown in section;

FIG. 3 is similar to FIG. 2 except that the liner has reached its final resting position at the bottom of the blast hole and has been filled with explosive; and FIGS. 4 and 5 are enlarged, largely schematic sectional views taken respectively on lines 4—4 and 5—5 of FIGS. 2 and 3.

A broadside elevational view of the lower portion of a blast hole liner 10 is shown in FIG. 1 of the drawing. The unit may be symmetrical in construction and a view from the rear, relative to FIG. 1, would be identical. By way of example, the length of the liner unit 10 may be 50 feet or more and may range in diameter from several inches to a foot or more.

The liner 10 is intended for insertion into a blast hole 11 as illustrated in section in FIGS. 2, 3 and 5.

The liner 10 as illustrated has a flexible inner tube 12 which may be 6 mil polyethylene and a flexible outer tube 14 which may be 4 mil polybutylene. Tubes 12 and 14 may be made from flattened tubular stock which is supplied in rolls of varying width. Tubes 12 and 14 have respective transversely extending seams 16 and 18 at their lower ends in close proximity to each other. These seams are waterproof seals, such as heat seals, made in accordance with well known practices. The seams 16 and 18 may be coextensive and formed simultaneously, but preferably are separate to provide two separate barriers to water seepage.

The materials and thicknesses referred to above, although representing a preferred embodiment, are not critical to the invention. Only one of the tubes (the inner tube) need be waterproof. It is impractical to pre-test the waterproof characteristics of each liner before use, and hence it is desirable to fabricate the liners with redundant waterproofing safeguards by using two separate waterproof tubes.

Although substantially any waterproof, flexible material may be used for the inner tube 12, low density polyethylene of about 0.003–0.012 inches in thickness is preferred. The outer tube material should exhibit reasonably good resistance to abrasion and puncturing and, as indicated above, desirably is waterproof. Polybutylene film (PB-131, Witco Chemical Corporation), a high molecular weight, isotactic polymer polyerized from butene-1 of a thickness somewhat less than that of the inner tube, has given good results as the outer tube material.

The upper ends of tubes 12 and 14 are open to allow the filling or charging thereof with suitable explosive and detonator materials and fusing means. The overall length of the liner is sufficient to allow a few feet thereof to protrude from the top of the blast hole after filling and stemming the liner.

A short (eg., from about 1 to about 3 liner diameters, typically 1–1½ feet) sleeve 20 surrounds the liner adjacent the bottom end thereof, and is sealed transversely (at 22) at its bottom end to the bottom end of the tube 14 with the sleeve being open upwardly. The diameter of the sleeve is only very slightly greater than that of the tube 14, and hence closely conforms to the latter. The sleeve may be made of any suitable material, such as polybutylene, and need not be waterproof. The flat walls of the sleeve and the tube 14 define betweem them weight pockets 20, 21, one on each side of the liner. To prevent the pockets from distending too greatly when weighting material is added, fastening means, exemplified in the drawing as adhesive tape (with longitudinal glass fibers) sections 23, 24, 25 and 26 are employed to fasten the flat sides of the sleeve to the tube 14 at points above the seam 22. The fastening means are desirably positioned adjacent the edges of the tube 14 so as not to interfere with opening of the pockets 20 and 21. Various other fastening means, such as spot heat seals, will be evident to the ordinarily skilled artesan.

In practice, a number of liners 10 will be wound on spools or folded with transverse folds to facilitate storing in stacks. At the site of a blast hole in a mine field where normally many blast holes have already been prepared, a workman will begin by unwinding a few feet of a liner 10 from a spool or draw a few feet from a folded stack. He will manually grasp the top edge of one of the pockets and pull it outwardly to open the pocket so weighting material may be inserted. The weighting material may be any heavy material 30 such as rock which may be found at the mine site. It is very desirable that weighting material be inserted only in one pocket 20 or 21 but is it immaterial which pocket is chosen.

The workman will then guide the loaded pocket 20 or 21 into the blast hole and carefully feed the liner unit 10 into the hole as the weighted pocket descends into the hole.

As illustrated in FIG. 2, the weighted pocket 20 forms a pointed, generally bullet-shaped leading end. If a blast hole should not be substantially straight, the pointed front of the pocket will thread its way down the hole without the likelihood of it getting hung up or stuck at any irregular part of the blast hole. The weight of the single weighted pocket unbalances the liner and tends to draw the flattened liner into a curled configuration, as shown in FIG. 4, the liner thus presenting a generally cylindrical cross section to the blast hole to facilitate lowering of the liner in the hole. It will be noted here that the bottom end of the liner is protected from tearing by at least two plys of material on one side, and is spaced from the often jagged wall of the blast hole by the protruding weight pocket on the other side.

When the pocket 20 reaches the bottom of the hole the contents of the weighted side will cause the weighted side to sag to one side of the hole as illustrated in FIGS. 3 and 5. This leaves a substantial part of the bottom of the liner unit 10 adjacent the bottom of the hole unoccupied and thus free to receive the explosive material. This is important from the standpoint of efficiency as indicated above because it allows the entire length of the blast hole, including the last foot or so at the bottom thereof, to react to the explosive charge. This is economically desirable because it is not only expensive to drill blast holes, especially in very hard rock, but it is the lower portion of a blast hole which would appear to have the greatest responsiveness to the explosion, the last foot of the hole being more effective in dislodging and breaking up material surrounding the blast hole than equal lengths of the hole above it.

After the weighted pocket reaches the bottom of the hole, the workman will pour or load the explosive charge and the detonating material into the liner unit 10 and, as mentioned above, this material will be allowed to also fill the very bottom of the hole.

Thus, manifestly, I have provided a blast hole liner which is capable of easy and inexpensive manufacture; and which has a pocket arrangement at its lower end which protects the liner as it is lowered to the bottom of a blast hole, which imparts a curling configuration to the thus lowered liner, and which yet permits explosive to be received at the very bottom of a blast hole.

While I have described a preferred embodiment of the present invention, it should be understood that various changes, adaptations, and modifications may be made therein without departing from the spirit of the invention and the scope of the appended claims.

I claim:

1. A blast-hole liner comprising an elongated, flattened, flexible waterproof tube having a transversely extending waterproof seal at the bottom end thereof and being open at its upper end to receive an explosive charge, a relatively short, flexible sleeve surrounding the lower end of the tube and secured at its lower end to the lower end of the tube, the sleeve being generally open at the top thereof, and fastening means supportively attaching the sleeve to the tube above the lower end of the latter, the tube having an explosive-receiving interior substantially coextensive downwardly with the lower end of the sleeve; whereby the sleeve forms with the tube an upwardly open weight pocket on each side of the tube.

2. The blast hole liner of claim 1 including a second elongated, flattened tube internally of said first named tube, said second tube having a transversely extending waterproof seal at its bottom end.

3. The blast hole liner of claim 1 wherein said fastening means includes a plurality of strips of adhesive tape.

4. The blast hole liner of claim 2 wherein the waterproof seal at the bottom of the second tube is separate from the seal of the first named tube.

5. A blast-hole liner comprising an elongated, flattened, flexible waterproof tube having a transversely extending waterproof seal at the bottom end thereof and being open at its upper end to receive explosive material; a relatively short, flexible sleeve surrounding the lower end of the tube and secured at its lower end to the lower end of the tube, the sleeves being generally open at the top thereof, and fastening means supportably attaching the sleeve at its top to the tube but permitting the top of the sleeve to be pulled away from the tube to expose an upwardly open weight pocket on each side of the tube, the explosive-receiving waterproof tube extending substantially to the terminal end of the weight pocket.

* * * * *